United States Patent [19]

Smith

[11] 4,355,831

[45] Oct. 26, 1982

[54] LOADING DEVICE FOR FIREWOOD

[76] Inventor: Jack B. Smith, Rte. 1, Box 297-A, Whitwell, Tenn. 37397

[21] Appl. No.: 223,825

[22] Filed: Jan. 9, 1981

[51] Int. Cl.[3] ..... A47J 49/00

[52] U.S. Cl. ..... 294/11; 294/17

[58] Field of Search ..... 294/11, 15–17, 294/30, 104, 106

[56] References Cited

U.S. PATENT DOCUMENTS

| | | | |
|---|---|---|---|
| 1,040,227 | 10/1912 | Maskrey | 294/17 |
| 1,070,526 | 8/1913 | Poole et al. | 294/17 |
| 1,338,023 | 4/1920 | Leduc | 294/106 |
| 1,467,192 | 9/1923 | Page | 294/17 |
| 2,706,131 | 4/1955 | Matz | 294/16 |
| 3,061,350 | 10/1962 | Miller | 294/16 |

FOREIGN PATENT DOCUMENTS

| | | | |
|---|---|---|---|
| 140480 | 5/1953 | Sweden | 294/17 |

*Primary Examiner*—Johnny D. Cherry

*Attorney, Agent, or Firm*—Gerald J. Ferguson, Jr.; Joseph J. Baker

[57] ABSTRACT

A device is disclosed for loading firewood into wood-burning stoves and the like which has a pair of opposed arms with pivotably joined horizontal portions and vertical portions connected thereto having dogs on the ends thereof for gripping the firewood. A handle is secured to the horizontal portion of one of the arms and has a V-shaped member attached at its apex to the handle for maintaining the piece of firewood aligned with the handle during transport.

5 Claims, 3 Drawing Figures

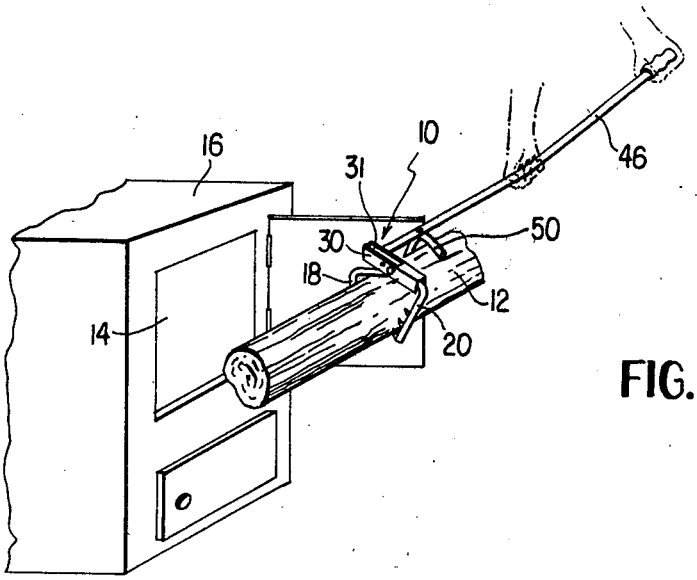
FIG. 1
FIG. 2
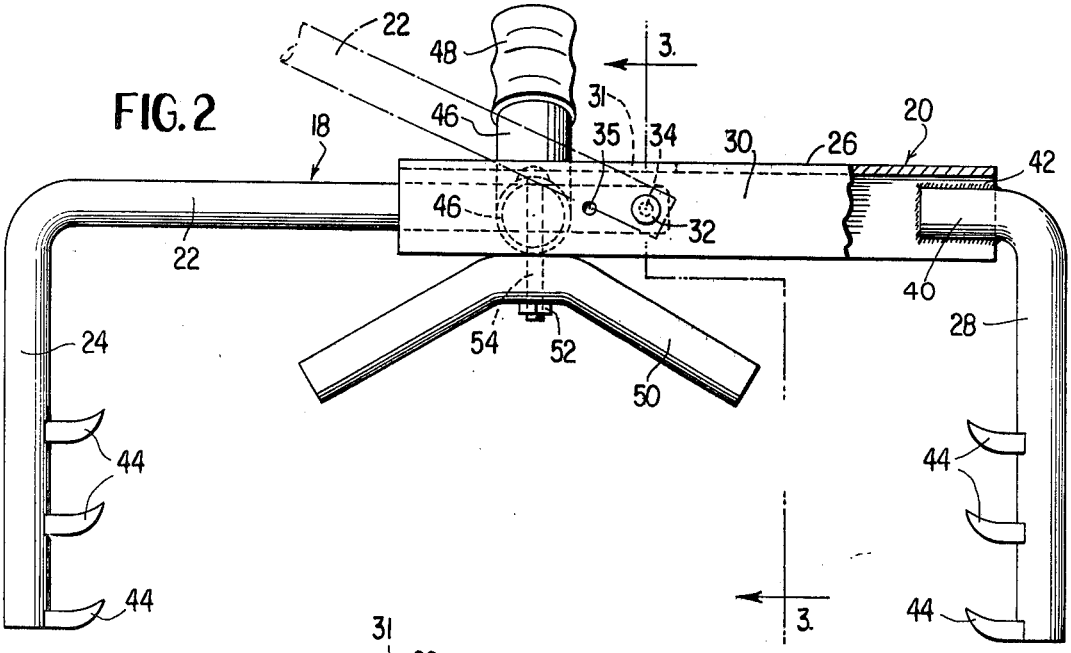
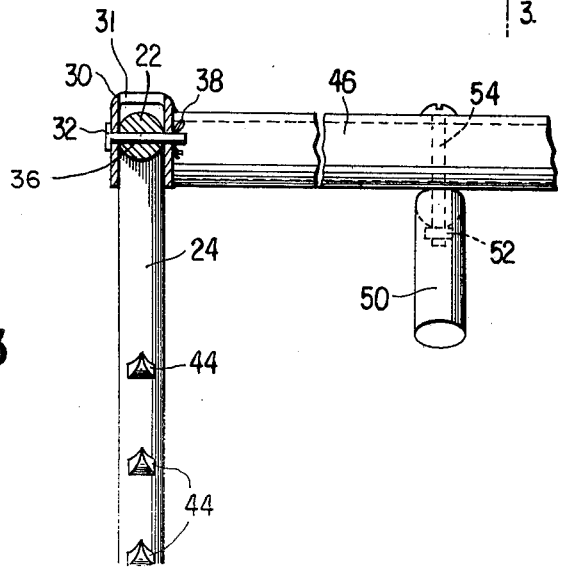
FIG. 3

LOADING DEVICE FOR FIREWOOD

BACKGROUND AND OBJECTS OF THE INVENTION

This invention relates to loading devices and more specifically to a novel and useful hand-held tool for transporting and loading firewood, particularly in the form of logs, into wood burning stoves, furnaces and the like.

It is a primary object of this invention to provide a device which is capable of securely transporting either substantially cylindrical shaped logs or sections thereof from a source to the entrance of a wood burning stove, furnace, fireplace or the like and then which is capable of holding the log during its horizontal insertion through the entrance to the unloading position where it is easily released.

The prior art structure in this area of which applicant is aware is examplified, for example, in U.S. Pat. No. 413,183, which discloses a fire tong of substantially U-shape having vertically depending arms with dogs on the ends thereof for engaging lumps of coal and the like when the gripping members connected to the horizontal arms are brought toward each other by the hand of the user. This type of device may function satisfactorily if the object being carried is in substantially lump form and if it does not have to be loaded horizontally through an opening in a wood burning device of the type aforementioned.

If, however, the object is a long log which must be transported to such a wood burning device, the prior art tool referred to is effective only if the log is gripped precisely at its longitudinal midpoint to ensure balance during transport. Horizontal insertion through a small loading door in the device is not normally possible with such a prior art tool and if attempted may result in bodily injury from burns.

The present invention overcomes the above-stated disadvantages of the prior art by providing a hand-held tool which is capable of easily grasping a long log in the general area of its longitudinal midpoint and keeping it aligned with the handle of the device to ensure its steady transport as well as insertion through a horizontally facing opening of such wood burning devices as well as its easy release at the desired location within said device.

It is therefore a further primary object of the present invention to provide a superior loading device for firewood.

It is another object of the present invention to provide a loading device which, due to its unique construction, is particularly suitable for transporting firewood from a source into position within a wood burning device having a horizontally facing door or opening.

It is yet another object of the present invention to provide a loading device which can easily grip and release a piece of firewood by simple rotation of its handle.

It is a further object of the present invention to provide a loading device for firewood which is simple and economical in construction and easily used without special skill.

Various other objects of the invention will be apparent from the following description taken in connection with the accompanying drawings wherein:

FIG. 1 is a perspective view of the firewood loading device of the present invention prior to insertion into the horizontally facing opening of a wood burning device, FIG. 2 is an enlarged front elevational view of the device in partial cross-section, and FIG. 3 is a cross-sectional view of the device taken along the lines 3—3 of FIG. 2.

DETAILED DESCRIPTION OF INVENTION

Referring now to the drawings where like characters of reference indicate like elements in each of the several views, numeral 10 refers to the firewood loading device of the present invention. The device 10 is shown in FIG. 1 in position for horizontal insertion of a typical shaped log 12 through the loading doorway 14 of a conventional wood burning furnace 16.

The loading device 10 comprises, as can best be seen by referring to FIGS. 2 and 3, oppositely disposed arms 18,20. The arm 18 is made entirely of a metal rod, preferably steel, bent at right angles to form a horizontal portion 22 and a vertical portion 24. The arm 18 can also be made of tubular metal, if desired. The arm 20 has a horizontal portion 26 and a vertical portion 28. The horizontal portion 26 consists primarily of a U-shaped section 30 to which is pivotably joined the horizontal portion 22. The horizontal portions 22,26 pivot on a clevis pin 32 which extends through holes 34,36 in U-shaped section 30 and horizontal portion 22 respectively. The U-shaped section 30 has a longitudinally extending recess 31 formed in the upper surface thereof which extends from the edge to a point behind clevis pin 32. The recess 31 permits the arm 18 to rotate into the recess thereby permitting the vertical portions 24, 28 to open wide during unloading of the log 12 as shown by the phantom lines in FIG. 2. The clevis pin 32 is maintained in position by means of a clip 38 attached thereto.

The horizontal portion 26 also consists of a section 40 which is at right angles to and formed of the same metallic material as vertical portion 24. The section 40 is secured within the U-shaped section 30 by means of welding 42 or the like. Additional holes 35 can be provided through U-shaped section 30 which are spaced from but aligned with hole 34 to enable the opening of the arms 18,20 to be increased if the size of the log 12 so dictates.

The vertical portions 24,28 have a plurality of spaced apart dogs or spikes 44 secured to the inner surfaces thereof for gripping and holding the log 12. The dogs 44 may be of varying lengths, the longer of which is secured to the vertical portions 24,28 adjacent the ends thereof and gradually decreasing in length therefrom.

A handle 46 is provided having a plastic-like grip 48 on one end thereof and secured at the other end thereof to the outer surface of the side of U-shaped section 30 by welding 42 or the like. The handle 46 also has a substantially V-shaped guide 50 attached to the underside of the handle 46 by means of a nut and bolt 52,54, respectively. The guide 50 is spaced ideally between two and three inches from the U-shaped section 30 for best results as will be more fully understood during the description of the operation of the device. The guide 50 can be made out of a section of either rod-like or tubular material, preferably metallic.

To operate the device 10, the handle 46 is gripped as shown in FIG. 1 and rotated counterclockwise to pivot the arms 18,20 to their open position, i.e. vertical portions 24,28 their greatest distance from each other. The underside of the log is then engaged by the dogs 44 on one of the vertical portions and the handle 46 is rotated clockwise until the dogs 44 on the other vertical portion engage the underside of the log. The log is ideally gripped in the area adjacent its midpoint so that one end thereof pivots on the dogs 44 into engagement with the guide 50. The guide 50 then maintains the log steady in a position where it is aligned with the handle 46. After the log has been transported to its desired position within the furnace 16 or the like, the handle is rotated counterclockwise once again to thereby free the log. As aforementioned, the recess 31 permits the arm portion 22 to pivot through the U-shaped section 30 to open the vertical portions 24,28 wider and facilitate freeing of the log.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. A loading device for logs and the like comprising:

(a) a pair of opposed arms each having a vertical portion and a horizontal portion, said vertical portion having one or more inwardly extending dogs for gripping said logs and said horizontal portion of each arm being joined at a point for pivotal movement therebetween;

(b) a handle secured transverse to said horizontal portion of one of said arms a distance offset from said point of pivotal movement whereby rotation of said handle in one direction causes said dogs of said vertical portion to engage said log and rotation of said handle in the other direction causes said dogs of said vertical portion to release said log; and (c) means on said handle for aligning said log relative to said opposed arms during transport.

2. A loading device for logs as set forth in claim 1 wherein said horizontal portion of one of said arms has a substantially U-shaped section to which said handle is attached and within which said horizontal portion of said other arm pivots.

3. A loading device for logs as set forth in claim 2 wherein said U-shaped section has a plurality of sets of aligned holes extending through the sides thereof and said horizontal portion of one of said arms pivots on a pin extending through a hole in the end of said horizontal portion and through one of said sets of aligned holes.

4. A loading device for logs as set forth in claim 2 wherein said U-shaped section has a recess extending inwardly from one end thereof to permit said horizontal portion of said other arm to extend therethrough during pivoting thereof.

5. A loading device for logs as set forth in claim 1 wherein said means for aligning said logs is a substantially V-shaped member secured at its apex to said handle adjacent said opposed arms.

* * * * *